US005802751A

United States Patent [19]

Schwieterman

[11] Patent Number: 5,802,751

[45] Date of Patent: Sep. 8, 1998

[54] ORNAMENTAL AIRCRAFT HAVING MULTIPLE MOVING PARTS

[76] Inventor: Vernon V. Schwieterman, 8310 121 Ave. North, Largo, Fla. 34643

[21] Appl. No.: 578,722

[22] Filed: Apr. 3, 1996

[51] Int. Cl.[6] ..... G09F 19/08

[52] U.S. Cl. ..... 40/414; 40/411; 446/232

[58] Field of Search ..... 40/411, 414, 415; 446/230, 232; 428/7, 15

[56] References Cited

U.S. PATENT DOCUMENTS

| | | | |
|---|---|---|---|
| 1,586,261 | 5/1926 | Nabors | 40/411 |
| 1,771,397 | 7/1930 | Chluda | 446/230 X |
| 1,798,358 | 3/1931 | Slachter | 40/411 |
| 1,953,728 | 4/1934 | Schmermund | 446/232 |
| 4,279,098 | 7/1981 | Kulesza et al. | 446/232 |
| 4,682,079 | 7/1987 | Sanders et al. | 428/7 X |

*Primary Examiner*—Brian K. Green
*Attorney, Agent, or Firm*—Ronald E. Smith

[57] ABSTRACT

A decorative aircraft has a rotatable propeller, a movable rudder, and a decorative pilot figure that also moves. The rotatable propeller is attached to a first output shaft of a motor positioned in the leading end of the fuselage of the aircraft. The motor is connected to a string of Christmas tree lights so that it is activated when the lights are turned on. A second output shaft is disposed normal to the first output shaft and oscillates an elongate control rod that extends from the motor to a rudder at the trailing end of the fuselage, and the decorative pilot figure is attached to the control rod. Motor operation causes the elongate control rod to oscillate, and the oscillation causes periodic movement of the rudder and the decorative pilot figure.

5 Claims, 3 Drawing Sheets

ORNAMENTAL AIRCRAFT HAVING MULTIPLE MOVING PARTS

BACKGROUND OF THE INVENTION

1. Field of the invention

This invention relates, generally, to Christmas tree decorations. More particularly, it relates to a decorative aircraft having multiple moving parts that are operated by an electric motor.

2. Description of the prior art

Inventors have developed a number of Christmas tree ornaments having moving parts to enhance the aesthetic value of Christmas displays.

For example, U.S. Pat. No. 5,277,048 to Daun discloses a stationary Christmas tree ornament, such as a house or church building, having an electric motor positioned therewithin. The motor rotates an output shaft to which is secured an elongate rod having a Santa Claus at one end and a snowman at the other. Thus, as the shaft rotates, the Santa and snowman orbit the building.

Another device, quite similar to the Daun device, is disclosed in U.S. Pat. No. 3,233,090 to Wagner. The primary distinction between such disclosures is that the central housing, in the Wagner construction, rotates together with the orbiting devices.

The same type of small motor may be used to rotate conventional Christmas tree ornaments as well, as disclosed in U.S. Pat. No. 4,980,608 to Morrison. In the Morrison disclosure, the motor is not housed as in the Daun and Wagner disclosures; instead, it is exposed to view. Due to its small size, however, it is easily concealed behind tree branches and needles.

The motor disclosed in the Morrison patent is adapted in U.S. Pat. No. 5,280,682 to rotate a wide variety of devices.

Thus, the earlier inventions in this field may be placed into two primary categories: 1) Devices that orbit about a stationary object; and 2) Devices that rotate about their own axis. A third category would include devices such as the Wagner structure which provide both motions.

One drawback of orbiting or rotating displays is that the moving items are somewhat hard to see. A viewer will be able to tell that an airplane or a sleigh is orbiting about an ornament, for example, but details of the airplane or sleigh will not be readily ascertainable. If the central ornament is also rotating, its features will not be readily ascertainable either.

What is needed, then, is a moving ornament that neither rotates about its own axis nor includes orbiting parts. It would also be advantageous if the ornament were not restricted to Christmas tree displays, but were to have year-round utility as decoration for a child's bedroom or other suitable room.

However, in view of the prior art at the time the present invention was made, it was not obvious to those of ordinary skill in this art how such an improved ornament could be provided.

SUMMARY OF THE INVENTION

The present invention provides an aesthetically-pleasing display where the ornament itself neither rotates about its own axis nor has items orbiting around it. Still, the ornament has moving parts that enhance the aesthetic value thereof.

Advantageously, the novel ornament may be wired in electrical communication with a string of Christmas tree lights so that it is activated whenever the tree lights are activated. It may just as easily be plugged directly into an alternative power source so that its use is not restricted to the environment of a Christmas tree.

A first embodiment of the novel ornament is provided in the form of a small aircraft having a motor-driven rotatable propeller. A second embodiment includes a movable rudder, and a third embodiment adds a decorative pilot figure who moves back and forth within a cockpit when the motor is running.

More specifically, the novel decorative aircraft of this invention includes a longitudinally disposed fuselage, a cockpit opening formed in said fuselage, an electric motor positioned in a forward end of said fuselage, said motor including a first rotatable output shaft, said first rotatable output shaft being longitudinally disposed, a propeller mounted to said first rotatable output shaft, a source of electric power for operating said motor, said source of power being disposed remote from said aircraft, an elongate conductor disposed in interconnecting relation between said source of power and said motor, said elongate conductor extending through said cockpit opening, whereby activation of said motor causes rotation of said propeller.

The second embodiment further includes a rudder mounted to a trailing end of said fuselage, an upstanding rod to which said rudder is attached, a boss means formed in said fuselage for receiving said upstanding rod, a bell crank having a first end secured to said upstanding rod, said motor including a second rotatable output shaft, said second rotatable output shaft being disposed normal to said first rotatable output shaft, a disc member secured to said second rotatable output shaft, an elongate, rigid control rod having a first, leading end pivotally connected to said disc member and a second, trailing end pivotally connected to a second end of said bell crank, whereby rotation of said disc member by said second rotatably mounted output shaft effects periodic displacement of said bell crank and said rudder.

The third embodiment includes a decorative pilot figure attached to said elongate control rod, said decorative pilot figure extending upwardly through said cockpit opening so that rotation of said second rotatably mounted output shaft effects periodic displacement of said decorative pilot figure.

It is therefore understood that a primary object of this invention is to advance the art of decorative ornaments having moving parts to enhance their aesthetic appeal and to inject life into an otherwise inanimate display.

A closely related object is to accomplish the foregoing object in the absence of an ornament that rotates about its own axis of rotation or that orbits about a central base member.

These and other important objects, features, and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which:

FIG. 3 is a side elevational view of the preferred embodiment.

DETAILED DESCRIPTION OF THE PREFERRED EMBODIMENT

Figure 1:
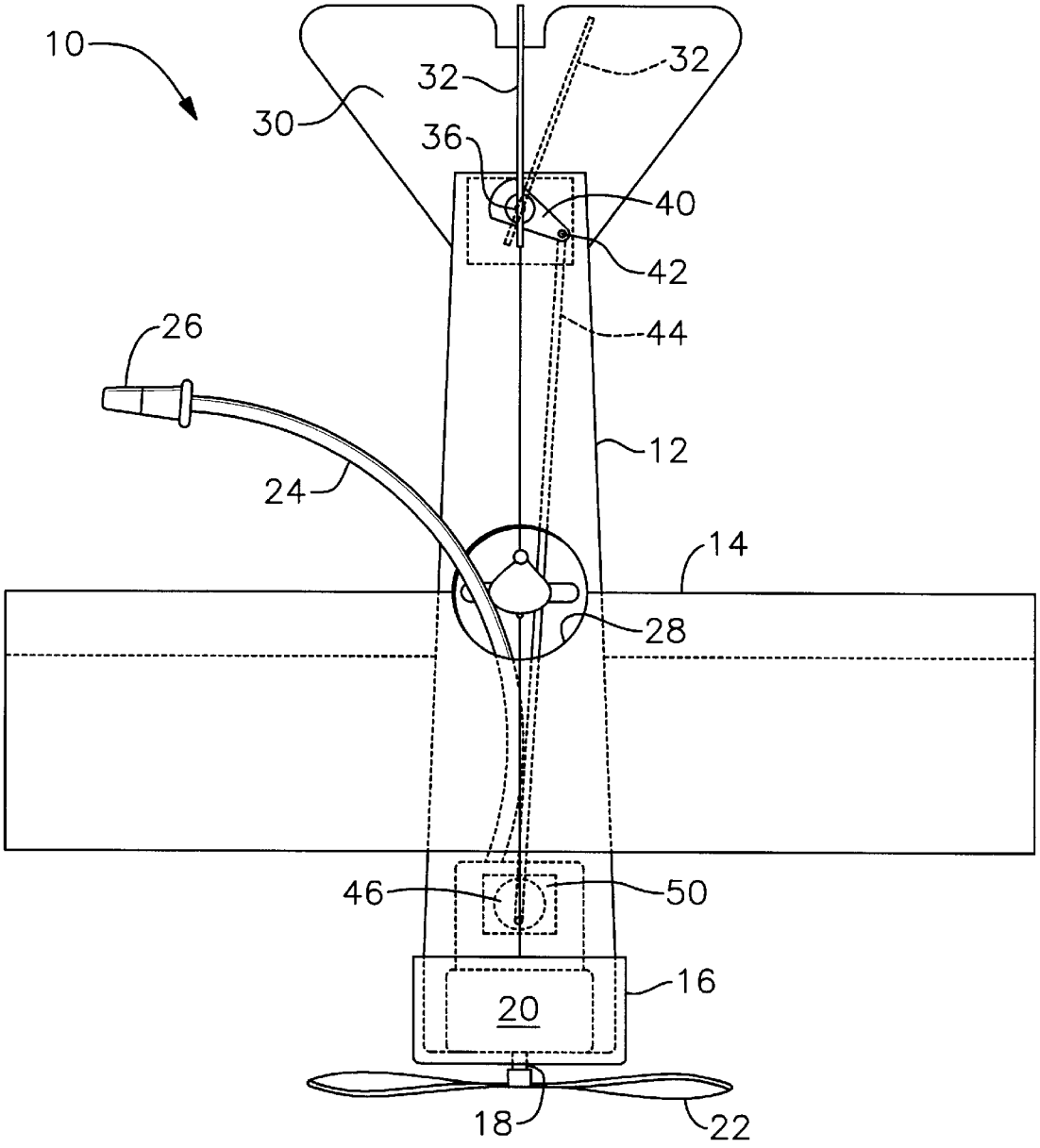
FIG. 1 is a top plan view of the novel ornament.

Referring now to FIG. 1, it will there be seen that an exemplary embodiment of the invention is denoted as a whole by the reference numeral 10.

Ornament 10 includes a longitudinally disposed fuselage 12 and transversely disposed wings 14. Cowling 16 is mounted to the leading end of fuselage 12; it includes a central opening to accommodate first rotatable output shaft 18 of electric motor 20, and propeller 22 is secured to said first rotatable output shaft. Electrical conductor 24 extends from the trailing end of motor 20 and terminates in a plug 26 that is adapted to be received into a socket 27, that forms a part of a string of lights 25 that includes a plurality of such plug-receiving sockets. Conductor 24 extends through a cockpit opening 28 formed in fuselage 12.

Figure 2:
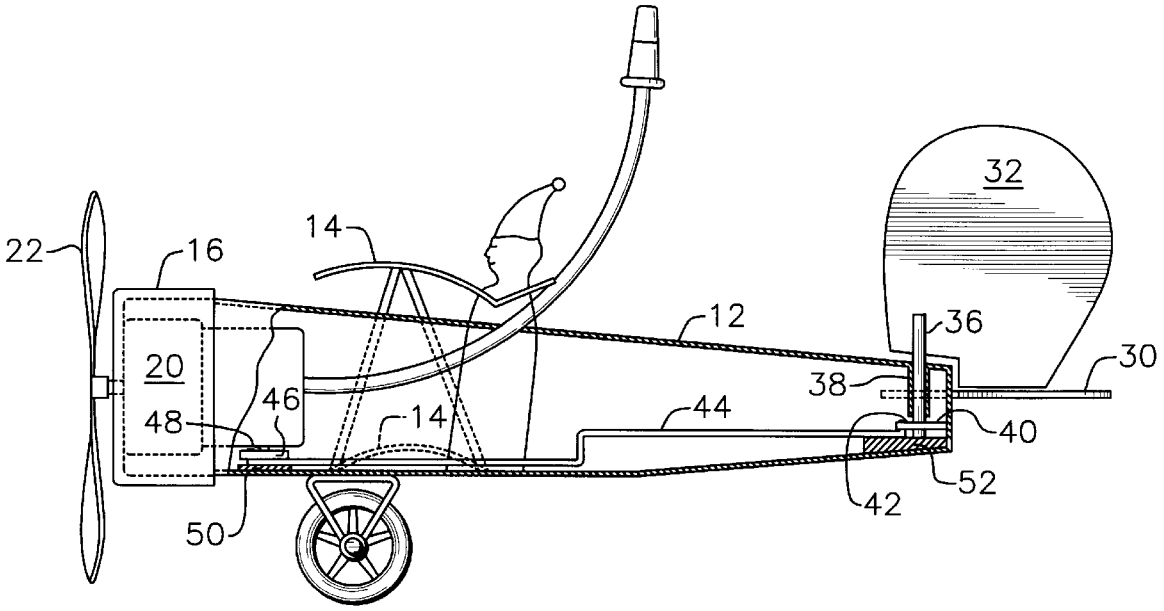
FIG. 2 is a top plan view of the novel rudder control mechanism of this invention.

Aircraft 10 further includes a horizontally disposed elevator 30 and an upstanding rudder 32 that is pivotal about axis 34. Axis 34, as perhaps best understood in connection with FIG. 2, is defined by an upstanding rod 36 that is rotatably held in said upstanding configuration by a boss means 38 formed in the trailing end of fuselage 12.

A first end of bell crank 40 is secured to upstanding rod 36 and a second end of said bell crank includes a pivotal mount 42 (FIG. 1) for the trailing end of an elongate, rigid control rod 44.

Figure 1A:
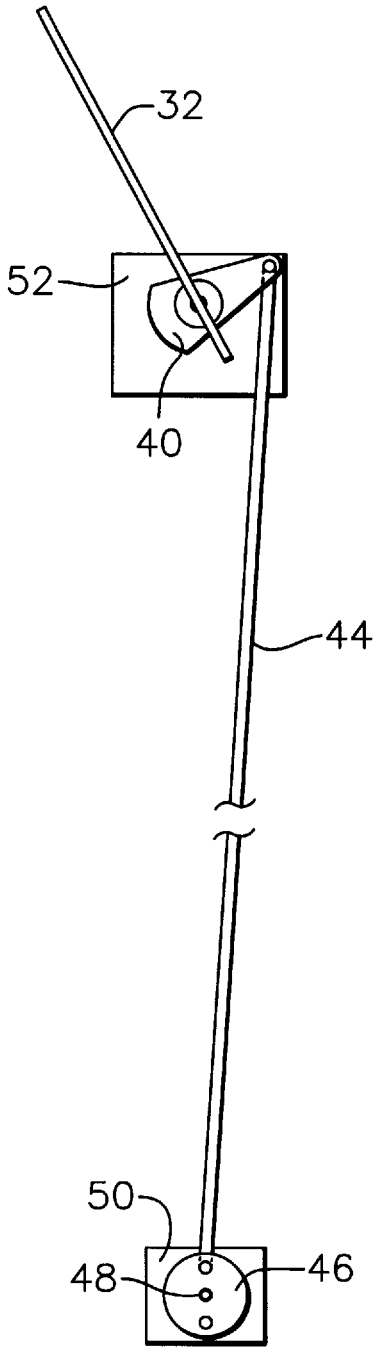

As perhaps best understood in connection with FIG. 1A, the proximal end of control rod 44 is pivotally secured to a rotatably mounted, horizontally disposed disc 46 that is connected to a second rotatable output shaft 48 that is positioned normal to the first rotatable output shaft, said second output shaft also being rotated by motor 20; a suitable speed reduction gear arrangement is used to connect said second output shaft 48 to said motor. Thus, rotation of second output shaft 48 effects rotation of disc 46 and the leading end of control rod 44, which motion translates into pivotal motion of rudder 32 relative to axis 34 defined by rod 36.

The rectangular member 50 that underlies disc 46 is a cushioned pad for supporting the weight of the trailing end of motor 20 and the disc assembly; a similar cushioned pad 52 supports the rudder-pivoting assembly at the trailing end of control rod 44.

Note in FIG. 1 that part of control rod 44 is visible through cockpit opening 28 when aircraft 10 is viewed in plan view. Thus, a decorative pilot figure, such as a Santa Claus if airplane 10 is to be used as a part of a Christmas display, may be secured to such rod. As the rod oscillates essentially coincident with its longitudinal axis, the pilot figure will move with it, thereby providing a third motion to accompany the rotation of propeller 22 and rudder 32.

Aircraft 10 may be used as a treetop ornament or it may be suspended from a branch just like a conventional ornament. Moreover, it may be parked on a runway-simulating strip under a tree in take-off position, or in a scene depicting an airport. Moreover, as mentioned earlier, it need not be associated with a Christmas display at all.

The motor, preferably of the type disclosed in the above-mentioned patent to Morrison, generates insufficient power to cause injury to those who might touch the rotating propeller or other moving parts. The propeller will stop rotating if it meets with the slightest resistance, and will rotate in an opposite direction upon re-starting.

Thus, the display is safe, attractive, and entertaining; it enlivens any display of which it is a part. Moreover, the aircraft can be carefully visually inspected as it operates so that its details of construction may be appreciated.

It will thus be seen that the objects set forth above, and those made apparent from the foregoing description, are efficiently attained and since certain changes may be made in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described.

What is claimed is:

1. A stationary decorative aircraft for display, comprising:

a longitudinally disposed fuselage;

a cockpit opening formed in said fuselage;

a low voltage electric motor positioned in a forward end of said fuselage;

said motor including a first rotatable output shaft;

said first rotatable output shaft being longitudinally disposed;

a propellor mounted to said first rotatable output shaft;

an elongate conductor disposed in interconnecting relation between a source of power and said motor;

said elongate conductor extending through said cockpit opening;

a rudder mounted to a trailing end of said fuselage;

an upstanding rod to which said rudder is attached;

a boss means formed in said fuselage for receiving said upstanding rod;

a bell crank having a first end secured to said upstanding rod;

said motor including a second rotatable out-put shaft;

said second rotatable output shaft being disposed normal to said first rotatable output shaft;

a disc member secured to said second rotatable output shaft;

an elongate, rigid control rod having a first, leading end pivotally connected to said disc member and a second, trailing end pivotally connected to a second end of said bell crank;

whereby activation of said motor causes rotation of said propellor; and whereby rotation of said disc member by said second rotatable output shaft effects periodic displacement of said bell crank and said rudder.

2. The decorative aircraft of claim 1, further comprising a plug member disposed at a free end of said elongate conductor so that said plug member may be connected to any suitable low voltage power source.

3. The decorative aircraft of claim 2, wherein said plug member is capable of being connected to any suitable socket in a string of low voltage lights.

4. The decorative aircraft of claim 1, further comprising:

a decorative pilot figure attached to said elongate control rod;

said decorative pilot figure extending upwardly through said cockpit opening;

whereby rotation of said second rotatable output shaft effects periodic displacement of said decorative pilot figure.

5. The decorative aircraft of claim 1, wherein said low voltage electric motor reverses automatically rotation of said first rotatable output shaft when said propeller meets resistance.

* * * * *